US005642555A

United States Patent [19]

Lin

[11] Patent Number: 5,642,555

[45] Date of Patent: Jul. 1, 1997

[54] PRESS-TYPE FASTENER

[76] Inventor: Ching-mau Lin, P.O. Box 453, Taichung, Taiwan

[21] Appl. No.: 615,721

[22] Filed: Mar. 13, 1996

[51] Int. Cl.[6] ..... A43C 11/00

[52] U.S. Cl. ..... 24/70 SK; 24/70 R; 24/70 ST; 24/68 SK

[58] Field of Search ..... 24/68 R, 68 A, 24/70 R, 68 SK, 71 SK, 70 SK, 70 ST, 584, 585; 36/50.5

[56] References Cited

U.S. PATENT DOCUMENTS

| | | | |
|---|---|---|---|
| 3,662,435 | 5/1972 | Allsop | 24/70 SK |
| 4,670,946 | 6/1987 | Olivieri | 24/71 SK |
| 4,683,620 | 8/1987 | Valsecchi et al. | 24/71 SK |
| 4,761,859 | 8/1988 | Calabrigo | 36/50.5 X |
| 4,765,069 | 8/1988 | Baggio et al. | 24/68 SK X |
| 5,172,454 | 12/1992 | Martignago | 24/68 SK |
| 5,416,952 | 5/1995 | Dodge | 24/68 R |

*Primary Examiner*—Peter M. Cuomo
*Assistant Examiner*—Hanh V. Tran

[57] ABSTRACT

A press-type fastener comprises a retaining bottom base, a retaining block, a press top base, an action toothed block, and a one-way toothed belt. The retaining block is fastened pivotally with the retaining bottom base while the action toothed block is fastened pivotally with with the press top base. The one-way toothed belt is fastened or unfastened by the action toothed block when the press top base is pressed and released repeatedly.

1 Claim, 6 Drawing Sheets

PRESS-TYPE FASTENER

FIELD OF THE INVENTION

The present invention relates generally to a fastening device, and more particularly to a press-type fastener intended for use in the sports goods.

BACKGROUND OF THE INVENTION

The conventional press-type fastener is commonly used in the exercise devices. As shown in FIG. 1, a prior art press-type fastener comprises a toothed belt 10 and a fastening set. The fastening set is composed of a base 11, a fastening block 12, a retaining base 13, and a retaining block 14. The base 11 is provided at the center thereof with two fastening holes 15 and is further provided with two pivoting lugs 16 having a pin hole 17. The fastening block 12 has an arm 18, a round hole 19 and a slot 20. The retaining base 13 is provided respectively on two sides thereof with a pivoting lug 21 having a pin hole 22. The retaining block 14 is provided at the front end thereof with a projection 23 and at the rear end thereof with a toothed face 24 and further at the center thereof with an elongated hole 25. The arm 18 of the fastening block 12 is fastened pivotally with the pivoting lug 16 of the base 11 by means of a rivet 26 which is received in the pin hole 17 and the round hole 19. The retaining base 13 and the retaining block 14 are fastened pivotally with the base 11 in conjunction with a spring 28 by means of a long pin 27 which is received in the slot 20.

In operation, the toothed belt 10 is inserted into the retaining base 13 and is then located by the retaining block 14 in conjunction with the spring 28. As the fastening block 12 is pulled down, the fastener makes the exercise device secure.

Such a prior art press-type fastener as described above has inherent shortcomings, which are expounded explicitly hereinafter.

The toothed belt 10 does not work precisely as expected in view of the fact that the fastening block 12 must be pulled open each time when the toothed belt 10 is adjusted.

The toothed belt 10 is vulnerable to damage or breakage under a great, pressure of the fastening block 12 in view of the fact that the toothed belt 10 is not securely located by the retaining block 14.

The prior art press-type fastener is devoid of a microadjustment device capable of facilitating the use of the exercise device by an exerciser with ease and speed.

SUMMARY OF THE INVENTION

It is therefore the primary objective of the present invention to provide an improved press-type fastener, which comprises a toothed belt and a fastening set. The fastening set is composed of a retaining bottom base, a retaining block, a press top base and an action toothed block. The fastening set can be microadjusted to facilitate the use of the press-type fastener and to prolong the service life span of the toothed belt.

The foregoing features, structures, functions and advantages of the present invention will be more readily understood upon a thoughtful deliberation of the following detailed description of an embodiment of the present invention in conjunction with the accompanying drawings.

DETAILED DESCRIPTION OF THE EMBODIMENT

Figure 1:
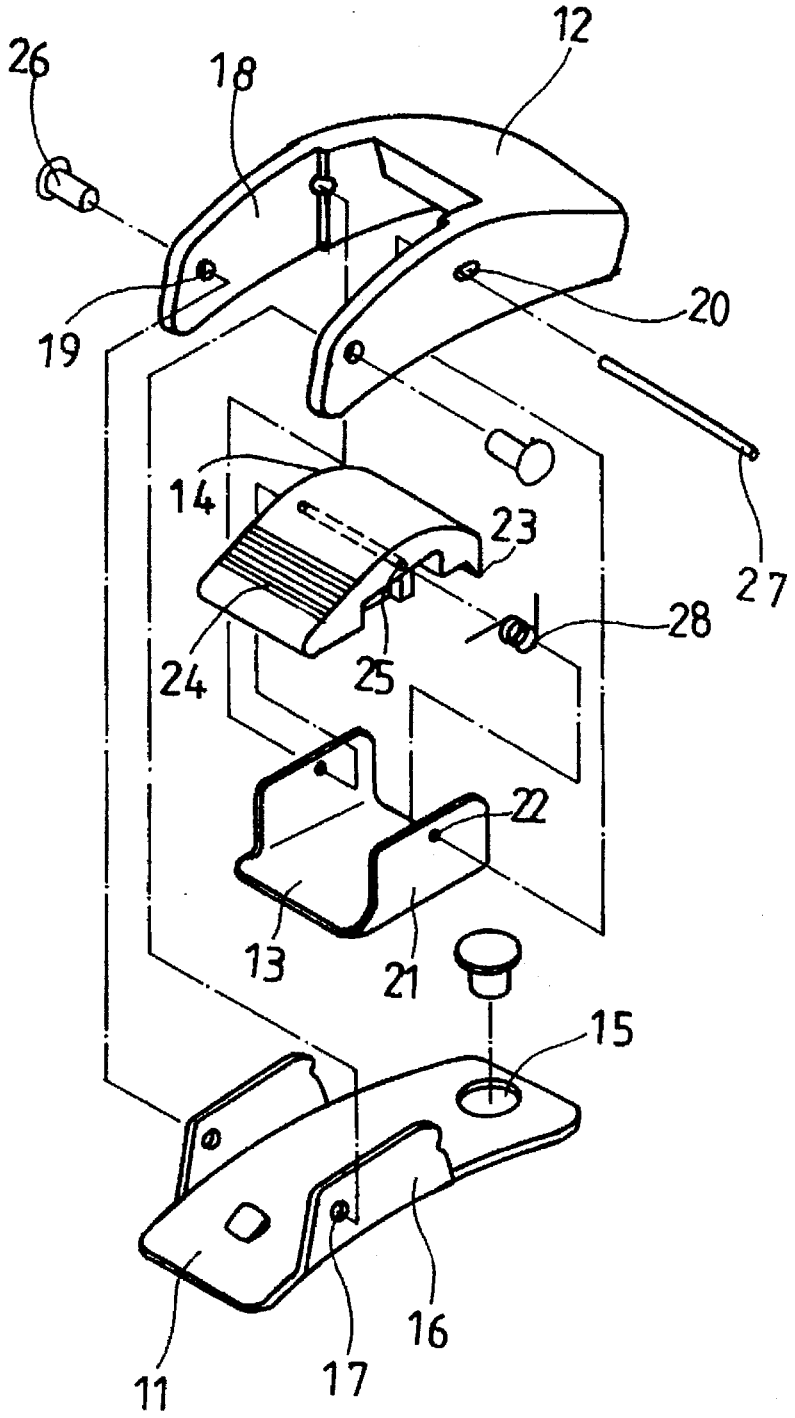
FIG. 1 PRIOR ART
FIG. 1 shows an exploded view of a press-type fastener of the prior art.
Figure 2A:
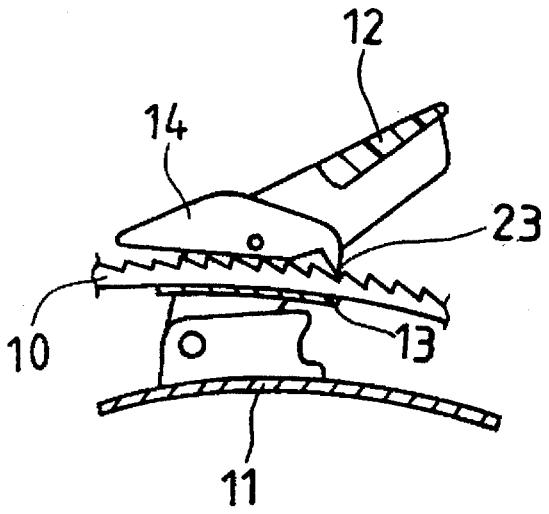
FIG.2A PRIOR ART
FIG. 2A–2B shows a schematic view of the prior art press-type at work.
Figure 2B:
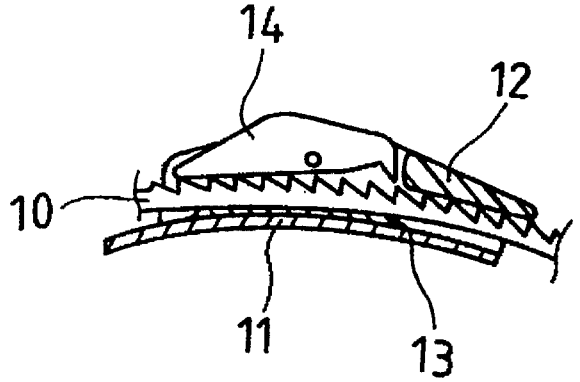
FIG.2B PRIOR ART
Figure 3:
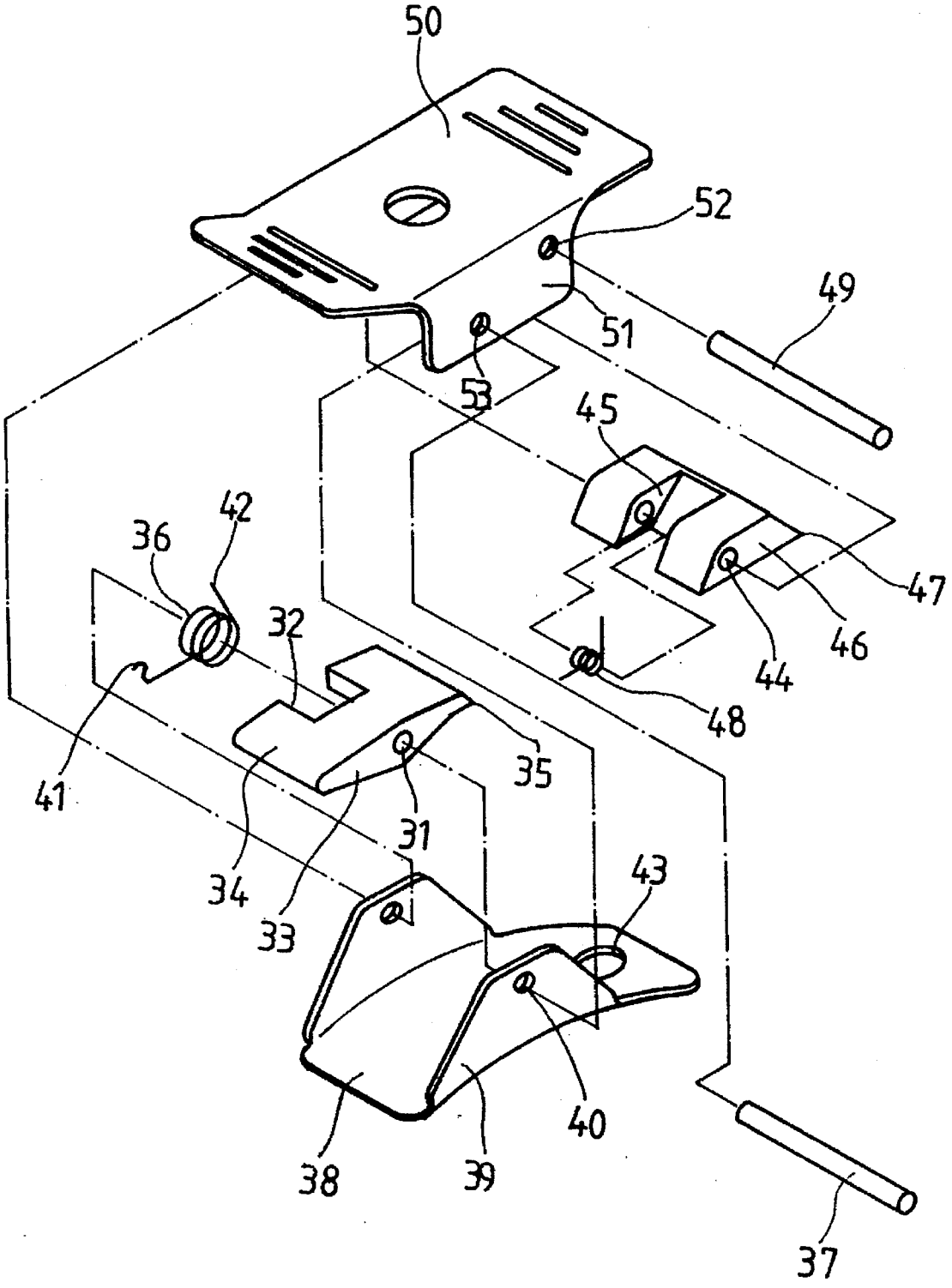
FIG. 3 shows an exploded view of a press-type fastener of the present invention.
Figure 4:
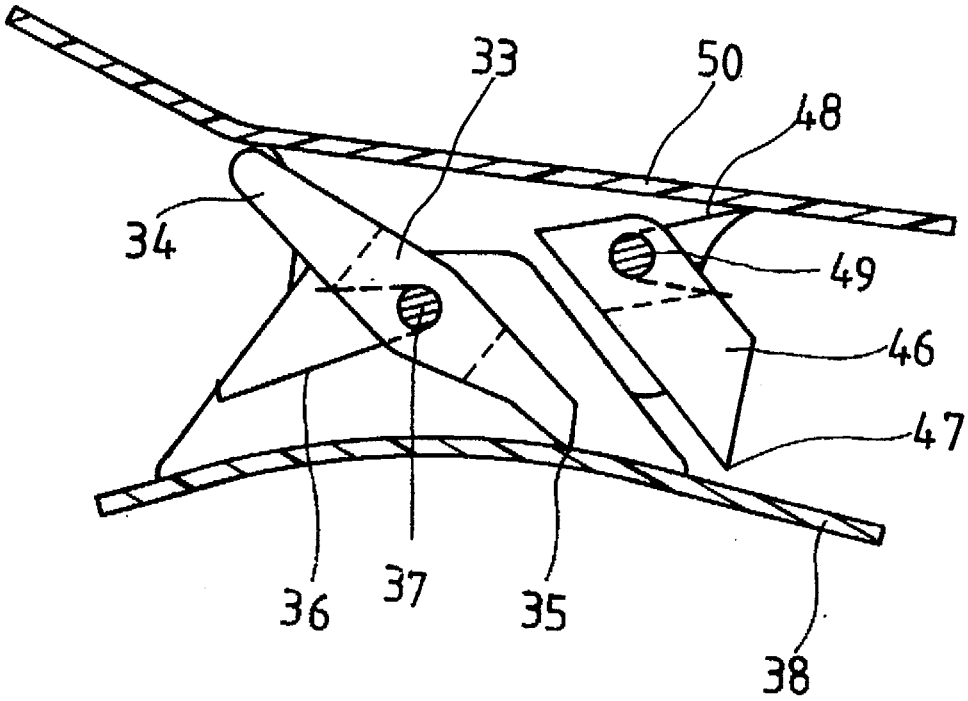
FIG. 4 shows a side schematic view of the press-type fastener of the present invention.

As shown in FIG. 3, a press-type fastener embodied in the present invention is composed of a retaining block 33, a retaining bottom base 38, an action toothed block 46, a press top base 50, and a one-way toothed belt 54.

The retaining block 33 has an axial hole 31 and a cut 32 and is provided at the front end thereof with a plate 34. The retaining block 33 is further provided at the rear end thereof with a retaining edge 35. The retaining block 33 is pivoted with the pivoting holes 40 of two lugs 39 of the retaining bottom base 38 by means of a shaft 37 in conjunction with a position-limiting spring 36 received in the cut 32 such that the hooked end 41 of the spring 36 is fastened with the lug 39 and that the urging end 42 of the spring 36 presses against the bottom of the cut 32 of the plate 34. The retaining bottom base 38 is provided with a fixation hole 43. The action toothed block 46 is provided at the front segment thereof with a pin hole 44 and a slot 45 and at the rear segment thereof with a toothed edge 47. The action toothed block 46 is fastened pivotally with the pin holes 52 of the ears 51 of the press top base 50 by means of a pin 49 in conjunction with a retrieving spring 48 received in the slot 45 such that one end of the spring 48 urges the top edge of the slot and that another end of the spring 48 presses against the bottom edge of the press top base 50. The ears 51 of the press top base 50 have a pivoting hole 53 coaxial with the shaft 37. The action toothed block 46 is located behind the retaining block 33.

Figure 5:
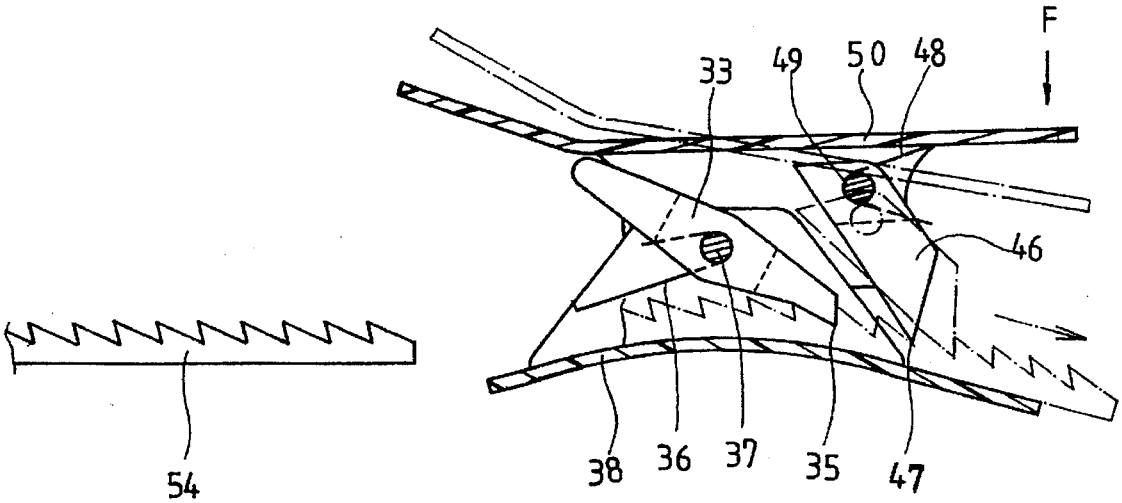
FIG. 5 is a schematic view showing the fastening of the press-type fastener of the present invention.

The locating effect of the one-way toothed belt 54 is attained by the retaining edge 35 of the retaining block 33 in conjunction with the position limiting spring 36. In addition, the locating effect of the one-way toothed belt 54 is further achieved by the toothed edge 47 of the action toothed block 46 in conjunction with the retrieving spring 44, as shown in FIG. 5.

Figure 6:
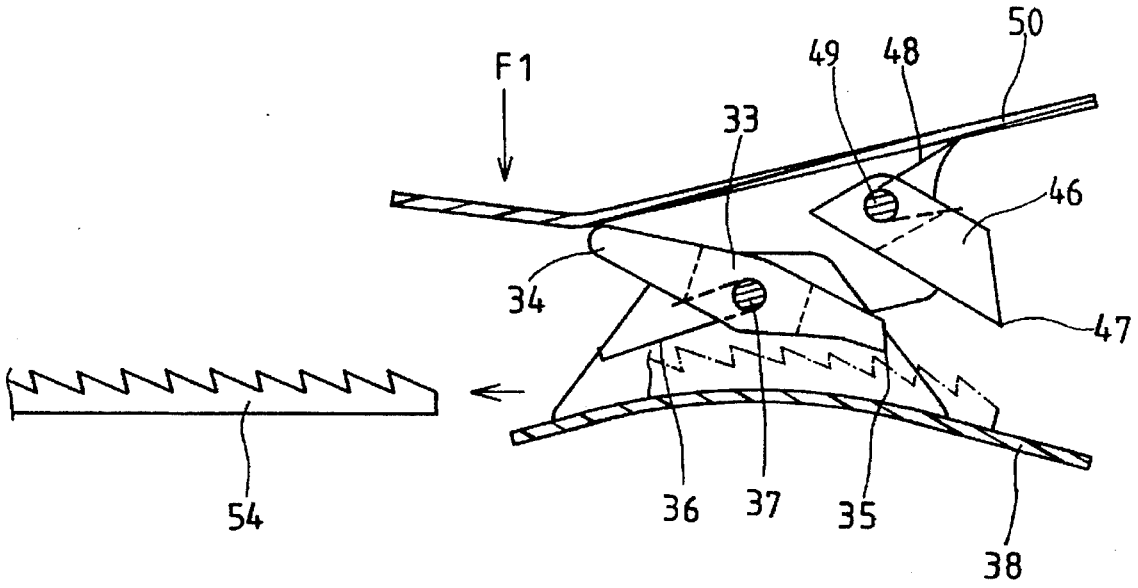
FIG. 6 a schematic view showing the unfastening of the press-type fastener of the present invention.

The one-way toothed belt 54 can be microadjusted by inserting the open end of the one-way toothed belt 54 into the open ends of the press top base 50 and the retaining bottom base 38 such that the open end of the one-way toothed belt 54 is put through the bottoms of the retaining block 33 and the action toothed block 46 before the open end of the one-way toothed belt 54 is emerged from another open ends of the press top base 50 and the retaining bottom base 38. Thereafter, one side (F) of the press top base 50 is pressed so as to cause the retrieving spring 48 to withdraw inwards, thereby actuating the action toothed block 46 to turn on the pin 49 serving as an axis. As the action toothed block 46 is actuated, the toothed edge 47 of the action toothed block 46 is caused to push the tooth tip of the one-way toothed belt 54. In the meantime, the retaining block 33 is also actuated such that the retaining edge 35 of the retaining block 33 is caused to pass the tooth tip of the one-way toothed belt 54 so as to bring about the retaining effect of the one-way toothed belt 54 in conjunction with the position limiting spring 36. As the press top base 50 is relieved of the pressure exerting thereon, the action toothed block 46 is pushed to another side by the retrieving spring 48 so as to cause the toothed edge 47 of the action toothed block 46 to pass the tooth tip of the one-way toothed block 46. The microadjustment of the one-way toothed belt 54 is attained by pressing repeatedly the press top base 50 to bring about a minute fastening of the belt 54. On the other hand, the minute unfastening of the one-way toothed belt 54 is brought about easily by pressing another side (F1) of the press top base 50 so as to cause the action toothed block 46 to move upwards, thereby causing the plate 34 of the retaining block 33 to be in motion so as to cause the retaining edge 35 of the retaining block 33 to move upwards to become disengaged with the one-way toothed belt 54, as shown in FIG. 6.

The press-type fastener of the present invention may be used along with a variety of goods, such as clothes, decorative items, luggages, in addition to the exercise devices.

The embodiment of the present invention described above is to be regarded in all respects as being merely illustrative and not restrictive. Accordingly, the present invention may be embodied in other specific forms without deviating from the spirit thereof. The present invention is therefore to be limited only by the scope of the following appended claim.

What is claimed is:

1. A press-type fastener, which comprises:

a retaining bottom base provided with a plurality of lugs each having a pivoting hole;

a retaining block fastened pivotally with said retaining bottom base by a shaft received in said pivoting holes of said lugs of said retaining bottom base, said retaining block provided with an axial hole, a cut, a plate, a retaining edge, and a position-limiting spring received in said cut such that one end of said spring is engaged with said lugs and that another end of said spring urges a bottom of said cut;

a press top base provided with a plurality of ears each having a pin hole and a pivoting hole;

an action toothed block having a pin hole, a slot, a toothed edge, and a retrieving spring received in said slot such that one end of said retrieving spring urges a top of said slot and that another end of said retrieving spring urges a bottom of said press top base, said action toothed block being fastened pivotally with said press top base by a pin received in said pin hole of said action toothed block and in said pin holes of said lugs of said press top base; and a one-way toothed belt capable of being fastened and unfastened by said action toothed block.

* * * * *